US008087929B2

(12) United States Patent
Santala et al.

(10) Patent No.: US 8,087,929 B2
(45) Date of Patent: Jan. 3, 2012

(54) EQUIPMENT AND METHOD FOR HEATING GAS IN CONNECTION WITH SINTERING

(75) Inventors: Pekka Santala, Espoo (FI); Janne Ollila, Tornio (FI); Juha Keihäs, Parainen (FI)

(73) Assignee: Outotec Oyj, Espoo (FI)

( * ) Notice: Subject to any disclaimer, the term of this patent is extended or adjusted under 35 U.S.C. 154(b) by 589 days.

(21) Appl. No.: 12/280,735

(22) PCT Filed: Mar. 5, 2007

(86) PCT No.: PCT/FI2007/000057

§ 371 (c)(1),
(2), (4) Date: Aug. 26, 2008

(87) PCT Pub. No.: WO2007/104828

PCT Pub. Date: Sep. 20, 2007

(65) Prior Publication Data

US 2009/0017409 A1 Jan. 15, 2009

(30) Foreign Application Priority Data

Mar. 15, 2006 (FI) ..... 20060242

(51) Int. Cl.
*F27B 9/28* (2006.01)

(52) U.S. Cl. ..... 432/8; 432/59; 432/133; 432/136

(58) Field of Classification Search ..... 432/8, 59, 432/128, 133, 136, 143–146, 148–150, 200, 432/152, 72, 199

See application file for complete search history.

(56) References Cited

U.S. PATENT DOCUMENTS

| | | | | |
|---|---|---|---|---|
| 2,215,080 | A * | 9/1940 | Hess | 432/26 |
| 3,612,498 | A * | 10/1971 | Voigt et al. | 432/22 |
| 3,947,001 | A | 3/1976 | Leighton | |
| 4,174,951 | A * | 11/1979 | Bloom | 432/133 |
| 4,251,062 | A | 2/1981 | Pobuda et al. | |
| 4,316,718 | A * | 2/1982 | Drugge | 432/58 |
| 4,332,551 | A | 6/1982 | Haslmayr et al. | |
| 4,689,007 | A | 8/1987 | Kilian | |
| 4,709,155 | A * | 11/1987 | Yamaguchi et al. | 250/554 |
| 5,556,273 | A * | 9/1996 | Mangham et al. | 432/8 |
| 5,690,485 | A * | 11/1997 | Mangham et al. | 432/8 |
| 6,494,712 | B1 * | 12/2002 | Charmes et al. | 432/175 |
| 6,767,206 | B2 * | 7/2004 | Niemela et al. | 432/152 |
| 2010/0162904 | A1 * | 7/2010 | Johansson | 99/468 |

FOREIGN PATENT DOCUMENTS

| | | |
|---|---|---|
| SU | 429252 | 7/1975 |
| WO | 0223111 | 3/2002 |

* cited by examiner

*Primary Examiner* — Gregory A Wilson

(74) *Attorney, Agent, or Firm* — Chernoff, Vilhauer, McClung & Stenzel

(57) ABSTRACT

The invention relates to equipment for heating gas in connection with continuous sintering in gas channels placed above a strand, the gas channels comprising at least a wall and at least two gas units, the gas coming from the gas units being in contact with the material on the strand, whereby at least one burner unit is arranged in at least one of the gas channels, being arranged as part of the gas channel, the burner unit comprising at least one separate combustion space arranged on the wall of the gas channel. The invention also relates to a method for heating the gas.

13 Claims, 2 Drawing Sheets

EQUIPMENT AND METHOD FOR HEATING GAS IN CONNECTION WITH SINTERING

This is a national stage application filed under 35 USC 371 based on International Application No. PCT/FI2007/000057 filed Mar. 5, 2007, and claims priority under 35 USC 119 of Finnish Patent Application No. 20060242 filed Mar. 15, 2006.

The invention relates to equipment and a method for heating gases in a circulation gas channel in connection with continuous sintering.

Continuous sintering at present uses a conveyor-type sintering device, wherein a bed of material is first formed on a conveyor belt. Generally, the material bed to be sintered consists of spherical pellets with a low strength or ore fines, which are made to harden by means of sintering, so that the pellets or the sinter can further be fed into a smelting furnace, for example, without problems with dust. Generally, the sintering device comprises separate zones for drying, pre-heating, and sintering the material to be sintered and for cooling the sintered product, the different stages being implemented by directing gas through the bed of material and the conveyor belt. For example, when treating ferro-alloy pellets, hot gas is directed through the bed of material and the belt in the sintering zone, so that the temperature of the bed is raised to a temperature range of 1000 to 1600° C. At the high temperature, the pellets or the sinter react with the hot gas, hardening at the same time. The hardened pellets are cooled by directing cooling gas through the bed of material and the belt.

As stated above, the heat treatment of the material to be sintered in the sintering device is implemented by means of gas by locating gas units around a strand in close proximity to the strand. Gas is thus directed to cooling, which takes place at the tail of the strand, from below the strand, for example, and the gas is sucked from above the strand into the circulation gas channels, wherein at least part of the gas is heated and directed to the beginning of the strand either to the drying, heating or sintering zones of the strand.

Conventionally, the gas used in sintering has been heated by means of separate combustion chambers located in connection with the circulation gas channel, wherein the combustion and decomposition air needed has also been fed into the burner along with fuel. In the solution according to publication U.S. Pat. No. 4,332,551, separate combustion chambers outside the gas channels are used for heating the gases.

This invention relates to equipment and a method for heating gases in the gas channel in connection with continuous sintering. In a sintering furnace, hot gas is directed from above the strand to sinter the material on the strand, and part of the gas channel is formed into a combustion chamber, wherein the gas is heated by means of separate burner units that are formed into part of the gas channel. According to the invention, at least one gas channel, which has at least a wall and at least two gas units, the gas coming from them being in contact with the material on the strand, has at least one burner unit arranged therein, being arranged as part of the gas channel, the burner unit comprising at least one separate combustion space arranged on the wall of the gas channel. According to a preferred embodiment of the invention, the burner unit comprises a supporting structure, which at least partially surrounds the combustion space and which can be adapted as part of the wall of the gas channel. Either one of the gaseous or liquid fuels, which are used for heating, is fired by means of an ignition burner and the combustion air, which has been fed, in a separate combustion space, after which no separate combustion air is needed for heating but the combustion air is obtained from the gas of the circulation gas channel. A combustion chamber is thus formed in at least some of the circulation gas channels, and no separate combustion chamber outside the gas channels is needed. However, separate combustion air that is fed can be used as combustion air, when necessary. The burner arrangement according to the invention can be used to provide an even temperature distribution in the gas channels, and by placing the burner unit in an inclined position with respect to the middle point of the gas channel, so that the angle between the centre line of the combustion space and that of the gas channel is preferably from 5 to 50 degrees, the behavior of the gas flows in the gas channel is advantageously influenced. The masonry of the gas channels does not suffer from the heat generated by the burner unit, as the burner unit can be positioned so that the heated gas flow is directed away from the masonry.

The burner unit according to the invention is preferably located in a bend of the circulation gas channel and far enough from the bed to be sintered. When there are several burner units, such as two per one gas channel, the control range becomes large and some burner units can be exploited in the start-up of the furnace. The burner unit is easy to detach and replace, which is necessary in connection with service, for example. The essential features of the invention are disclosed in the appended claims.

The equipment according to the invention is described in detail by means of the appended drawings, in which.

Figure 1:
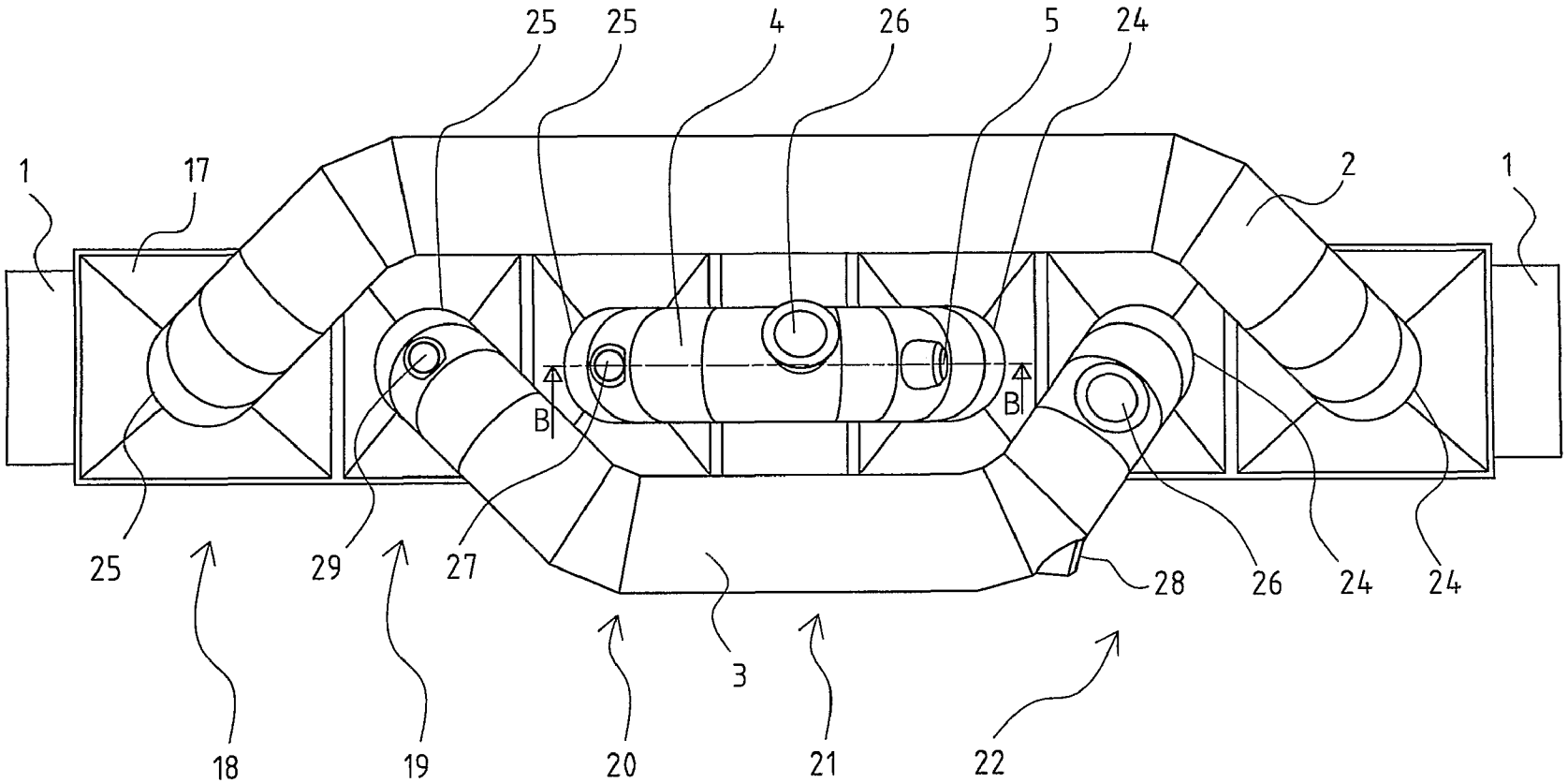
FIG. 1 is a skeleton diagram of the sintering equipment
Figure 2:
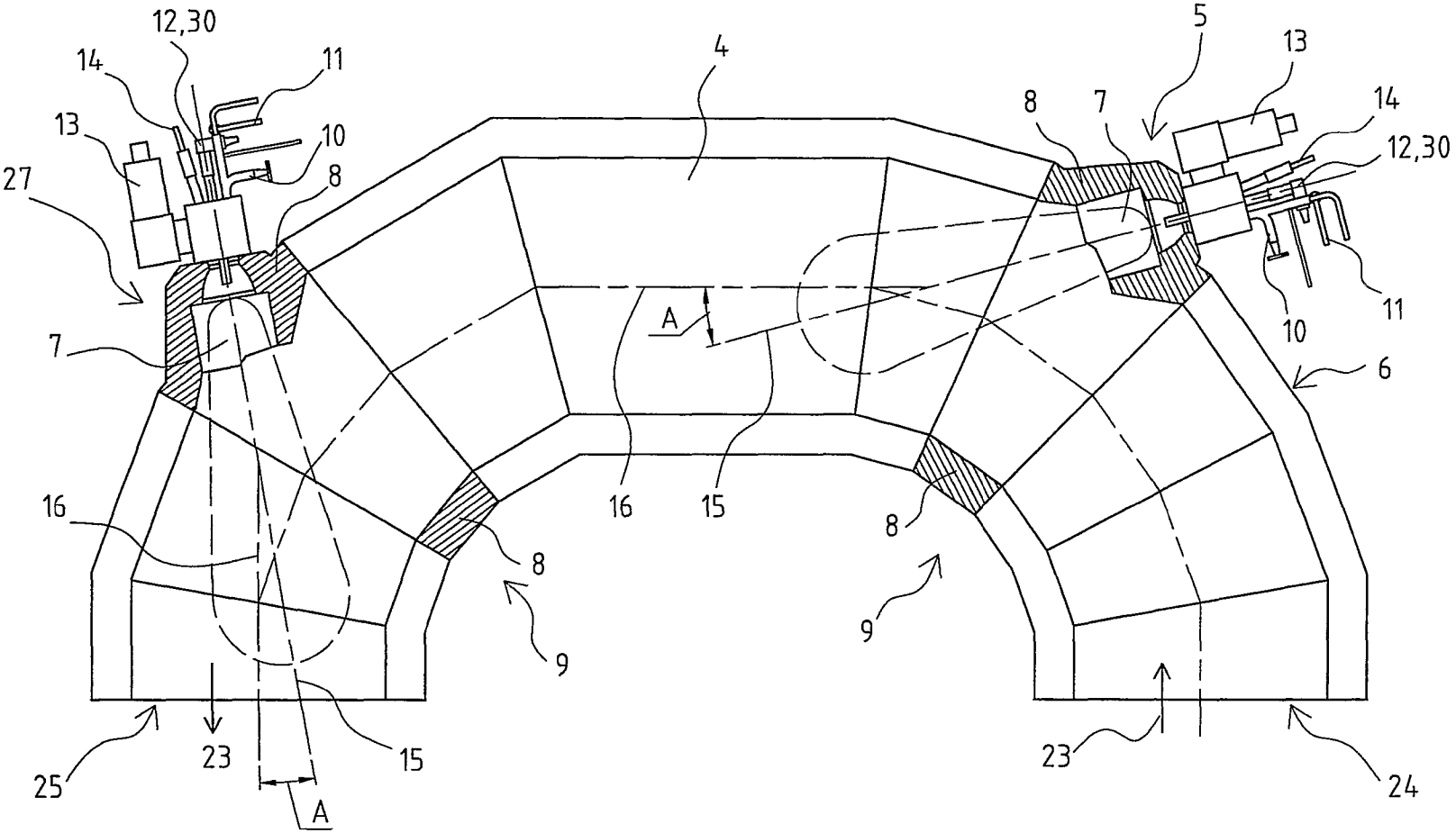
FIG. 2 is a sectional view along line B-B of FIG. 1.

According to FIG. 1, the sintering equipment consists of a strand 1, or sintering belt, which turns around cylinders that are at its ends (not shown), a sintering furnace 17 and associated gas channels 2, 3 and 4, or gas circulation ducts, where the gas circulates between the different parts of the sintering furnace. FIG. 2 shows in detail a sectional view of the gas channel 4 at point B-B. Continuous sintering comprises a closed gas cycle, and the circulating gas is exploited in the various parts of the process. The sintering device also comprises a supporting structure (not shown). The material to be sintered is fed so that if forms a bed on top of the strand 1. In the furnace, the material to be sintered first travels through a drying zone 18 and a pre-heating zone 19, moving then to a sintering zone 20 that has one or several parts. After the sintering zone, the equipment often comprises a stabilizing zone 21, after which there is a cooling zone 22 with several stages. Gas 23 is directed to the sintering equipment, first, to the various sections of the cooling zone through gas units 24. The gas units are connected to one or more blasters (not shown). After the gas has travelled through the strand 1 and the bed of material to be sintered, which is on top of the same, it is sucked from each of the sections into a respective gas channel 2, 3 and 4. The gas that is to be removed from the outermost gas channel 2 (as viewed in the flow direction of the material to be sintered) is directed to the drying zone 18, and this gas channel is generally not provided with burner units. Instead, the gas from the cooling sections located nearer to the middle part of the equipment is directed to the gas channels 3 and 4, which are provided with burner units 5, 27, 28 and 29. The inner part of the gas channel is made of refractory material. The gas channels that have a burner unit are also preferably provided with a gas removal unit 26, which is mainly intended for emergency cases. The sintered material is removed from the strand for further processing. The gases are removed from the sintering, pre-heating and drying zones to removal units 25. From there the gases are directed to gas cleaning and possibly recycled back to the sintering process.

FIG. 2 shows how the burner units 5 and 27 are placed in the gas channel 4. In the solution according to FIG. 2, the gas channel 4 comprises two burner units 5 and 27, which are placed at the bends 9 of the channel. The burner units 5 and 27 are arranged as part of the gas channel, each burner unit comprising a supporting structure 8 that is fitted as part of the wall 6 of the gas channel 3, 4 and is preferably made of the same material as the wall 6 of the gas channel. The supporting structure is formed with at least one recess in the wall 6 of the gas channel. The recess provides a combustion space 7, which is at least partly surrounded by the supporting structure 8 and the purpose of which is to protect the flame formed by the burner unit and the formation of the flame against any process gas flows 23 flowing in the gas channel. The combustion space 7 is dimensioned according to the amount of fuel used and the type of burner lance. The burner unit can be adopted as part of the gas channel, and the entire burner unit is easy to replace with another burner unit. The burner units 5 and 27 include supply ducts 10 and 11 both for a liquid fuel, such as oil, and for a gaseous fuel, such as CO gas. In addition, the burner unit includes an ignition burner 12, which fires the fuel and air sprayed into the combustion space 7, whereby a flame is formed, which is directed to the gas flow 23. It is obvious that the positions of the supply ducts of the fuels and the ignition burners may differ from the arrangement according to FIG. 2. However, the fuel can be replaced with another one without influencing the process. The fuels used can vary according to which one is the most economic in each process. However, it is preferable, though not necessary, that the burner unit 5 is provided with supply ducts for at least two different fuels. For example, even CO gas or LPG gas can be used for heating, if it is momentarily not possible to get oil.

The burner unit comprises a supply duct 30 for the combustion air that is used in firing the ignition burner 12, which makes it possible to fire a flame in the combustion space 7 of the burner unit. The equipment does not necessarily need a separate feeding of combustion air except for the ignition burner 12, which is used only when the heating begins. However, the burner unit is preferably provided with separate supply equipment 13 of combustion air, which can be used for feeding combustion air into the gas channel 4, when needed. Otherwise, the air needed for the combustion is obtained from the gas flowing in the circulation gas channels, i.e., the gas channel works as a combustion chamber. Furthermore, the burner unit comprises a flame detector 14 for maintaining and firing the flame. The burner unit is directed so that the flow of the process gases does not direct the flame towards the masonry material of the channel. Hence, the burner unit is placed in the gas channel 4 so that the angle A between the centre line 15 of the combustion space 7 of the burner unit and the centre line 16 of the gas channel is preferably from 5 to 50 degrees. Consequently, according to the example, the position prevents the gas flows 23 coming from the cooling zone 22 from hitting the protective masonry lying in the horizontal part of the gas channel.

According to the example, two burner units 5 and 27 are placed in the gas channel 4, the second one being able to work as a supporting burner for the first one or assist in the start-up of the furnace. In principle, the number of burner units may vary depending on the process conditions. The burner unit can easily be removed from the channel of circulation gas, for example, and placed into another similar burner unit, when the other one is damaged. The edge of the supporting structure 8 of the burner unit is preferably rounded to form as small as possible an obstacle to the gas flow 23 when flowing towards the burner unit.

It is obvious to those skilled in the art that the various embodiments of the invention are not limited to the examples above, but may vary within the appended claims.

The invention claimed is:

1. Equipment for heating gas in connection with continuous sintering in a gas circulation duct above a sintering belt, the gas circulation duct comprising at least a wall and at least two gas units, the gas coming from the gas units being in contact with the material on the sintering belt, wherein the gas circulation duct includes at least one burner unit that comprises a supporting structure installed as part of the wall of the gas circulation duct and formed with a recess in the wall of the gas circulation duct and providing a separate combustion space, whereby the supporting structure at least partially surrounds the combustion space.

2. Equipment according to claim 1, wherein the burner unit is in a bend of the gas circulation duct.

3. Equipment according to claim 1, wherein the burner unit comprises at least one supply duct for a gaseous fuel and at least one supply duct for a liquid fuel.

4. Equipment according to claim 1, wherein the burner unit comprises at least one ignition burner and a combustion air unit of the ignition burner.

5. Equipment according to claim 1, wherein the burner unit comprises supply equipment for the combustion air.

6. Equipment according to claim 1, wherein the burner unit comprises at least one flame detector.

7. Equipment according to claim 1, wherein the burner unit is placed in the gas circulation duct so that the angle (A) between the center line of the combustion space and the center line of the gas circulation duct is from 5° to 50°.

8. Equipment according to claim 1, wherein the burner unit is detachable from the gas circulation duct.

9. Equipment according to claim 1, wherein the gas circulation duct includes first and second burner units that comprise, respectively, first and second supporting structures installed as respective parts of the wall of the gas circulation duct and each formed with a recess in the wall of the gas circulation duct and providing a separate combustion space, whereby the first and second supporting structures at least partially surround the combustion spaces respectively, and wherein one of the burner units is a supporting burner unit.

10. Equipment according to claim 1, wherein the gas circulation duct defines a passage extending through the duct, the supporting structure comprises a wall portion that surrounds a segment of said passage, and the recess opens into said segment of said passage.

11. A sintering furnace for continuous sintering of material, comprising:

a sintering belt on which material to be sintered is placed, and gas circulation ducts above the sintering belt for directing hot gas onto the material to sinter the material, wherein at least one gas circulation duct includes at least one burner unit that comprises a supporting structure installed as part of a wall of the gas circulation duct and formed with a recess in the wall of the gas circulation duct and providing a separate combustion space, whereby the supporting structure at least partially surrounds the combustion space.

12. A furnace according to claim 11, wherein the gas circulation duct defines a passage extending through the duct, the supporting structure comprises a wall portion that surrounds a segment of said passage, and the recess opens into said segment of said passage.

13. A method for heating gas in connection with continuous sintering of material on a sintering belt, the method comprising:

directing gas from a gas circulation duct above the sintering belt onto the material on the sintering belt, heating the gas by means of at least one burner unit that comprises a supporting structure installed as part of a wall of the gas circulation duct and formed with a recess in the wall of the gas circulation duct and providing a separate combustion space, whereby the supporting structure at least partially surrounds the combustion space and protects a flame formed by the burner unit from gas flowing in the gas circulation duct, supplying fuel to the burner unit by means of at least one supply duct, and burning fuel supplied to the burner unit in said combustion space.

* * * * *